United States Patent [19]

Minning et al.

[11] 4,432,123

[45] Feb. 21, 1984

[54] PROCESS FOR THE MANUFACTURE OF DOUBLE WALLED PIPE

[75] Inventors: Rudolf Minning, Dortmund; Heribert Dierkes, Hagen, both of Fed. Rep. of Germany

[73] Assignee: UHDE GmbH, Dortmund, Fed. Rep. of Germany

[21] Appl. No.: 287,192

[22] Filed: Jul. 27, 1981

Related U.S. Application Data

[63] Continuation-in-part of Ser. No. 94,647, Nov. 15, 1979, abandoned.

[51] Int. Cl.[3] ..... B21D 21/00; B21D 9/10; B21D 53/06

[52] U.S. Cl. ..... 29/157 A; 29/455 R; 72/170; 72/369

[58] Field of Search ..... 29/157 A, 157 R, 234, 29/455 R, 445; 72/166, 169, 170, 171, 172, 133, 369, 367; 138/148

[56] References Cited

U.S. PATENT DOCUMENTS

| | | | |
|---|---|---|---|
| 1,908,373 | 5/1933 | Loepsinger | 72/166 |
| 2,936,019 | 5/1960 | Miller | 72/133 |
| 3,229,489 | 1/1966 | Huet | 72/166 |
| 3,293,897 | 12/1966 | Holter | 72/166 |
| 3,665,601 | 5/1972 | Dunbabin | 72/370 |
| 3,691,617 | 9/1972 | Burnett | 29/234 |
| 4,009,601 | 3/1977 | Shimizu | 72/369 |
| 4,022,019 | 5/1977 | Garcea | 29/157 R |
| 4,137,743 | 2/1979 | Schwarze | 72/369 |

FOREIGN PATENT DOCUMENTS

| | | | |
|---|---|---|---|
| 968635 | 6/1975 | Canada | 72/370 |
| 748085 | 10/1944 | Fed. Rep. of Germany | 72/166 |
| 1246917 | 10/1960 | France | 29/455 R |

*Primary Examiner*—Daniel C. Crane

*Attorney, Agent, or Firm*—Fraser, Barker, Purdue & Clemens

[57] ABSTRACT

The invention relates to a process for the manufacture of a rigid, essentially elbow-shaped coaxial double pipe with a hollow space between inner and outer pipes, consisting of an elbow-shaped cold-bent high-pressure pipe for operating pressures of over 1000 bar as the inner pipe, the two shanks of the elbow each comprising a straight piece of pipe with a length of at least 5 times the outside diameter, and an elbow-shaped cold or hot-bent outer pipe which envelops the inner pipe in a manner as to leave an annular space between inner and outer pipes and extending the length of the outer pipe, with the outer pipe enveloping the bend and one straight shank only. Elbow-shaped coaxial double pipes of this type can, for instance, be part of a heat exchanger of up to 3000 m in length in the form of a coil type cooler comprising a plurality of straight pipes and U-shaped bends.

4 Claims, 1 Drawing Figure

PROCESS FOR THE MANUFACTURE OF DOUBLE WALLED PIPE

CROSS-REFERENCE TO RELATED APPLICATION

This application is a continuation-in-part of copending application Ser. No. 94,647, filed on Nov. 15, 1979, now abandoned.

BACKGROUND OF THE INVENTION

1. Field Of The Invention

This invention relates to a process for producing bent, double wall rigid pipes.

2. Description Of The Prior Art

If an exothermal or endothermal reaction takes place inside the inner pipe and if cooling or heating is required, such a heat exchanger is known as a tubular reactor.

The hollow space between the inner and outer pipes of the double-walled tubular reactor serves for the passage of coolants or heating agents for the purpose of influencing the reaction temperature inside the tubular reactor. In order to achieve as uniform an effect of the coolant or heating agent as possible, attempts are made to achieve concentricity of inner and outer pipes, since this would create defined flow conditions in the hollow space between the pipes.

Whereas it is easy to meet this requirement in the case of straight pipes, considerable difficulties are encountered in the case of elbows which are normally 180-degree bends. The elbow-shaped cold-bent high-pressure pipes for operating pressures of over 1000 bar have a bending radius of about 7 times the high-pressure pipe diameter and larger, and have a straight piece of pipe of at least 5 times the outside diameter on each shank. This straight piece of pipe is required for the screwed joint with the next straight piece of pipe and for reasons of fabricating technique. It has further been found that the bending radius cannot be kept constant over the 180-degree bend, i.e. it fluctuates within a tolerance of ±0.10 m to 0.20 m. The reason for such non-uniformity is due to the fact that the high-pressure pipes are cold-bent and that they have different elastic recovery. Subsequent adjustment to the exact bending radius is not permissible.

The process used hitherto for jacketing a high-pressure pipe of the type described above consisted of bending the outer pipe by known means separately at a bending radius equal to the specified bending radius of the high-pressure pipe. The resulting outer pipe bend, which did not have any extended straight shanks, was then cut through either at the two lateral neutral bending lines or at the inner and outer phase of the bend. The two half-shells thus obtained were then placed around the high-pressure bend and adjusted to the actual shape of the bend by applying heat and by pressing. The cuts were then welded. This was followed by welding straight pieces of pipe to the extremities of the outer pipe shanks. The high-pressure inner pipe was centered in the center pipe by means of spacers.

The process used hitherto for jacketing an inner pipe is too costly and time-consuming because of the necessity to cut the outer bend and subsequently to weld the two half-shells together again. Moreover, in the course of welding, the outer pipe becomes distorted, resulting in a non-uniform hollow space within the bend. This will, in turn, result in non-uniform flow velocities of the coolant or heating agent, which fact will affect the heat transfer, thus causing unequal temperatures at various points within the high-pressure pipe bend. Besides the stresses caused by the high operating pressure, there will also be additional stresses due to temperature differences, which will have an adverse effect.

SUMMARY OF THE INVENTION

The aim of the invention is to eliminate the disadvantages of the known process for jacketing a high-pressure pipe. According to the invention, this aim is achieved in that the straight outer pipe is slipped over the bent high-pressure pipe and that both pipes are placed into a pipe bending apparatus in a manner as to leave the bent high-pressure pipe free laterally, the outer pipe being gripped by the pipe bending elements, and the outer pipe then being bent over the exposed high-pressure pipe while maintaining the concentricity of the specified hollow space between the pipes until the end of the high-pressure pipe bend is reached so as to produce uniform flow conditions in the hollow space.

BRIEF DESCRIPTION OF THE DRAWING

The above, as well as other objects of the invention, will become readily apparent to one skilled in the art from reading the following detailed description of a preferred embodiment of the invention when considered in the light of the accompanying drawing, in which.

DESCRIPTION OF THE PREFERRED EMBODIMENT

Figure 1:
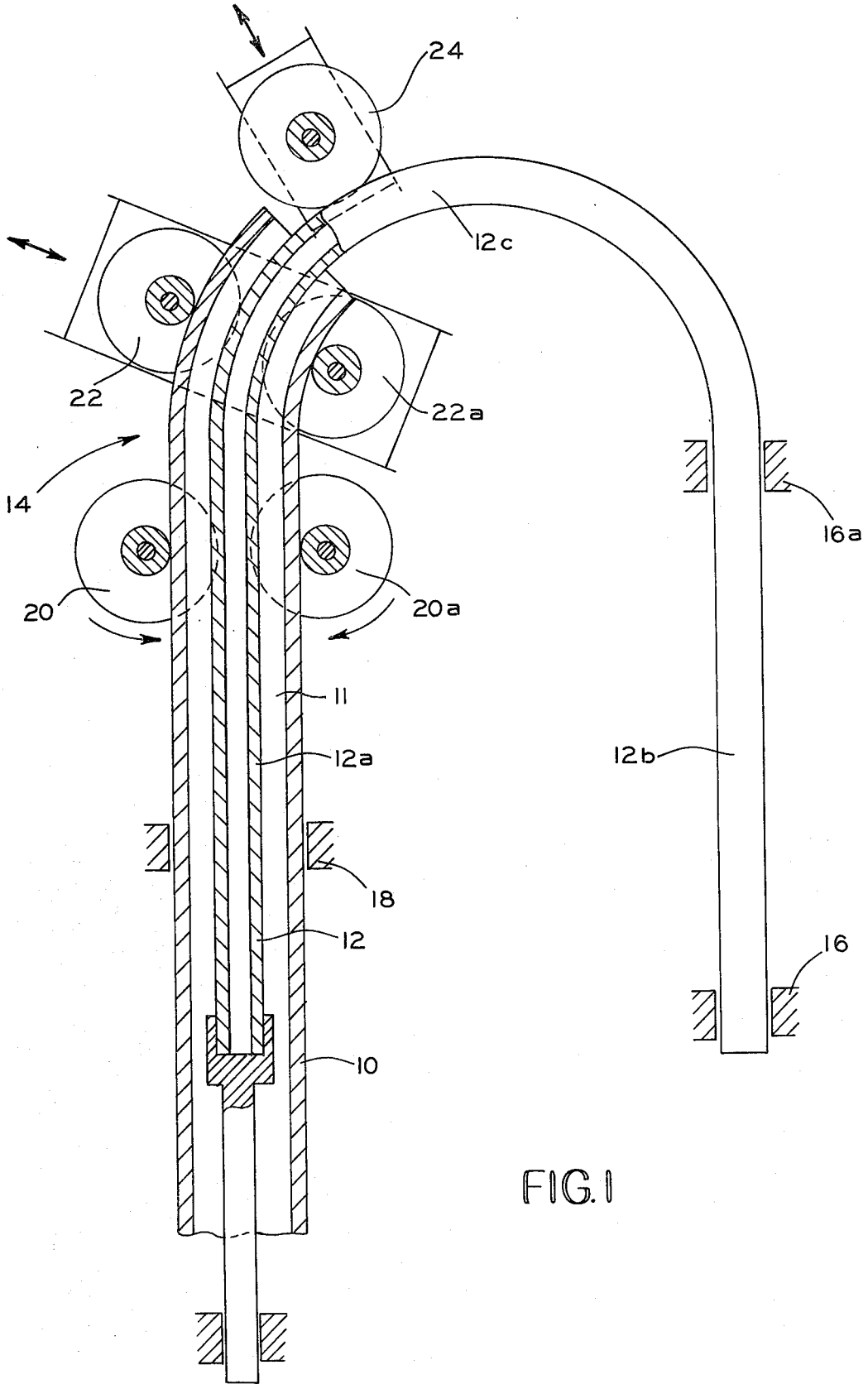
FIG. 1 is a schematic view of an apparatus for carrying out the process of the invention.

A particularly favorable method of shaping an outer pipe 10 over a high-pressure inner pipe 12 is to push it into a roller-type bending device 14 or to draw it through a slide-type bending device (not shown) while applying localized heat. According to a further embodiment of the invention, the outer pipe 10 is deformed over the exposed high-pressure pipe 12 in such a manner as to impart a "mean" curvature to the outer pipe section being subjected to bending, such that the "mean" curvature corresponds to that of the high-pressure pipe 12 enclosed by the outer pipe 10 in final state, the "mean" curvature being understood to mean the neutral axis of the bend.

More particularly, the straight outer pipe 10 is bent over the high pressure inner pipe 12 wherein the inner pipe is a prebent elbow-shaped member having a straight shank portion **12*a* and 12*b* extending from each end of an elbow 12*c*. The elbow-shaped inner pipe may be placed in any type of conventional pipe bending apparatus, such as the roller-type bending device 14, so that the center of its elbow 12*c* will be congruent with the center of the elbow to be produced on the outer pipe 10 with the axis of one of its straight shanks 12*a* aligned with the axis of the pipe bending apparatus 14 with that shank 12*a* being held laterally free of the bending apparatus 14 by the other shank 12*b* in any convenient manner, for example, by spaced, aligned clamping chucks 16 and 16*a*. The straight outer pipe 10 is slipped over the laterally free straight shank 12*a* of the inner pipe 12 through a guide block 18 in spaced relation thereto and continually moved by a pair of driving rolls 20 and 20*a* through a pair of bending rolls 22 and 22*a* and a guiding roll 24, all of which constitutes the pipe bending apparatus 14. Thus, the outer pipe 10 is bent around the elbow 12***c* of the inner pipe 12 and concentrically envelopes the elbow 12*c* and straight shank portion 12*a* of the inner pipe 12. Accordingly, a uniform flow condition will be set up in the hollow space 11 between the outer and inner pipes 10 and 12, respectively.

The advantages achieved by the process according to the invention are that the high-pressure pipe is enclosed by the outer pipe in one single bending operation without any additional cutting or welding. The cold-bent high-pressure pipe is not subjected to any additional thermal stresses. Even if the high-pressure pipe bend is not perfectly circular, it is possible to bend the outer pipe on passing it through the roller-type or slide-type bending device in such a manner that the "mean" curvature of both pipes is essentially equal in all places, i.e. in all pipe sections, thus achieving a uniform hollow space between the pipes throughout the entire pipe bend.

The following example illustrates the dimensions and deviations:

High-pressure 180-degree pipe bend; inside pipe diamater 50 mm; wall thickness 60 mm; mean pipe bend diameter 4 m; deviations from the mean bending radius of 2 m; approx. ±100 mm; straight shank length: 1 m at either end.

Outer 180-degree bend; inside pipe diameter 270 mm; wall thickness 8 mm; mean pipe bend diameter 4 m; deviations from the mean bending radius of 2 m; approx. ±100 mm, equal to those of the high-pressure bend at all places thereof.

In the case of large pipe bends, centering pins in the outer pipe are employed to prevent any sagging of the high-pressure pipe bend.

It will be appreciated from the foregoing description that the invention has resulted in a bent double wall pipe produced by a process which maintains a hollow space between an inner pipe and an outer pipe which uniformly extends the length of the bend which creates defined flow conditions in the hollow space.

In accordance with the provisions of the patent statutes, the principal and mode of operation of the invention has been explained and what is considered to represent its preferred embodiment has been illustrated and described. However, it should be understood that the invention may be practiced otherwise than as specifically illustrated and described without departing from its spirit and scope.

What is claimed is:

1. A process for manufacturing an elbow-shaped double pipe having an inner rigid pipe generally concentrically spaced from an outer rigid pipe to define a hollow space extending between the inner and outer pipes, comprising the steps of:

(a) providing a prebent inner rigid pipe having a straight shank portion extending from each end of a bent elbow portion;

(b) providing a straight section of outer rigid pipe;

(c) supporting the prebent inner rigid pipe in a pipe bending apparatus by gripping one straight shank portion of the inner pipe with the elements of the pipe bending apparatus so that the center of curvature of the bent elbow portion of the inner pipe is congruent with the center of curvature of the bending element of the pipe bending apparatus;

(d) slipping one end of the straight section of outer pipe over the other straight shank portion of the inner pipe;

(e) supporting the straight section of outer pipe in the pipe bending apparatus in generally concentric, hollow spaced relationship with the other straight shank portion of the inner pipe; and (f) advancing the outer pipe further onto the inner pipe and into the pipe bending apparatus and contacting only the exterior of the outer pipe with the pipe bending apparatus as the pipe bending apparatus bends the outer pipe around the bent elbow portion of the inner pipe while maintaining a generally concentric, hollow spaced relationship between the inner and outer pipes thereby forming an elbow-shaped double wall pipe.

2. A process according to claim 1, wherein step (f) comprises pushing the outer pipe through a roller-type bending apparatus holding the inner pipe.

3. A process according to claim 1, wherein step (f) comprises drawing the outer pipe through a slide-type bending apparatus holding the inner pipe.

4. A process according to claim 1, wherein step (f) comprises bending the outer pipe over the exposed inner pipe with a mean curvature corresponding to the mean curvature of the inner pipe.

* * * * *